FIP7811 OR 3,964,792

United States Patent [19]

Archibald

[11] 3,964,792

[45] June 22, 1976

[54] EXPLOSIVE FLUID TRANSMITTED SHOCK METHOD FOR MINING DEEPLY BURIED COAL

[75] Inventor: Paul B. Archibald, Pleasanton, Calif.

[73] Assignee: The United States of America as represented by the United States Energy Research and Development Administration, Washington, D.C.

[22] Filed: Jan. 28, 1975

[21] Appl. No.: 544,715

[52] U.S. Cl. ..... 299/13; 102/23; 166/299; 299/18

[51] Int. Cl.[2] ..... E21C 37/12

[58] Field of Search ..... 299/13, 17; 102/21, 102/23; 166/299; 175/2, 4.5

[56] References Cited

UNITED STATES PATENTS

| | | | |
|---|---|---|---|
| 2,676,662 | 4/1954 | Ritzmann | 166/299 |
| 3,083,778 | 4/1963 | Friedman et al. | 166/299 X |
| 3,393,013 | 7/1968 | Hammer et al. | 299/17 |
| 3,874,733 | 4/1975 | Poundstone et al. | 299/17 |

FOREIGN PATENTS OR APPLICATIONS

| | | | |
|---|---|---|---|
| 59,258 | 2/1970 | Poland | 299/13 |

*Primary Examiner*—Ernest R. Purser
*Attorney, Agent, or Firm*—Dean E. Carlson; F. A. Robertson; Irene S. Croft

[57] ABSTRACT

A method for recovering coal from deeply buried deposits comprising drilling a hole down into a coal seam, filling the hole with water, and periodically detonating an explosive charge at the bottom of the water-filled hole. The water transmits the explosive shock wave to the face of the coal seam, thereby fracturing and dislodging the coal. The resulting suspension of loose coal in water is then pumped to the surface where the coal is recovered and the water is recycled to the mining operation.

9 Claims, 2 Drawing Figures

EXPLOSIVE FLUID TRANSMITTED SHOCK METHOD FOR MINING DEEPLY BURIED COAL

BACKGROUND OF THE INVENTION

The invention disclosed herein was made in the course of, or under, Contract No. W-7405-ENG-48 with the United States Atomic Energy Commission.

This invention relates to a method for mining buried coal deposits, particularly, deeply buried, thick coal deposits. More specifically, this invention relates to an explosive-assisted hydraulic method, hereinafter termed "hydroexplosive mining", for mining deeply buried coal.

The northern Rocky Mountain states contain the nation's largest reserves of fossil energy in the form of thick deposits of coal. Many deposits are too deep to be developed by surface mining and too thick to be fully exploited by present underground mining methods. Coal seams which are 100 meters deep and 15 to 30 meters thick are at the marginal economic range of strip mining. The locations of many such seams are known; for example, in Montana the 15-meter-thick Decker seam is currently being strip mined through 18 meters of overburden. This horizontal seam extends under a range of low hills, and mining will stop when the overburden reaches a depth of 33 meters. Nine meters below the Decker seam is another seam 9 meters thick which will not be developed. An economically feasible method for developing such hitherto inaccessible deposits, particularly without adversely affecting the environment, would represent a valuable advance in coal mining technology.

It is known to mine certain water-insoluble ores, such as phosphates, from subterranean beds by the introduction of a water jet that forms an ore-water slurry which can be pumped or air lifted to the earth's surface as shown, for example, in Hammer et al, U.S. Pat. No. 3,393,013, issued July 16, 1968. As mentioned in the cited patent, however, one of the difficulties experienced in the removal of ore from an ore body in the form of a slurry or suspension is the relatively small amount of ore removable through a single well because of the fact that the effects of jets of water directed laterally from adjacent the axis of the well within the ore body do not penetrate very far radially if surrounded, as is usually the case, by a body of water which, except for the jet action, is relatively quiescent.

In the petroleum recovery art it is well known hydraulically to fracture petroliferous formations with the aid of auxiliary tools, such as explosives. However, in this art the hydraulic fracturing serves merely to increase the permeability of the formation to enhance recovery of oil therefrom; no extraction of ore is involved.

It is also known to drill holes with aid of explosives and to remove fragments of rock broken away by the explosion by circulating fluids through the annular space between the column of pipe and the hole. See A. P. Ostrovskii, *Deep-Hole Drilling with Explosives*, Consultants Bureau, N.Y., 1960, page 93. However, drilling operations involve the removal of only relatively minor amounts of material as compared to the large amounts of material which must be removed for an economically feasible mining operation.

SUMMARY OF THE INVENTION

In accordance with the present invention, a method for mining coal, particularly from deeply buried, thick coal deposits, is provided which comprises establishing a water-filled cavity in communication with a coal seam, and periodically detonating an explosive charge in the water-filled cavity. The water transmits the explosive shock wave to the face of the coal seam, thereby fracturing and dislodging the coal and forming a suspension of loose coal in water. The resulting suspension is then extracted from the coal seam, for example, by pumping to the surface. As the coal-water suspension is removed, a cavity forms which becomes progressively larger as mining operations proceed. In a preferred method of operation, the coal-water suspension is processed at the surface for recovery of coal therefrom, and waste water is returned to the borehole so that the progressively enlarging cavity in the coal seam is maintained substantially filled with water during mining operations.

More particularly, the borehole is preferably provided with two conduits, one conduit being used to deliver water and explosive charges to the cavity in the coal seam, and the second conduit being used to remove the coal-water suspension. The second, or producing, conduit is preferably adjustable in its vertical travel so that, as the diameter of the cavity increases due to removal of the coal-water suspension, the conduit can be extended to communicate with the lower part, or floor, of the cavity. Then, just prior to the detonation of an explosive charge, the conduit can be retracted to protect it from the force of the explosion.

In a specific mode of operation of the present mining method, the explosive charges are sized to the diameter of the cavity, the initial charge being relatively small and subsequent charges being successively larger as the diameter of the cavity increases.

Therefore, it is among the objects of the present invention to provide an economically feasible method for the recovery of coal from buried coal deposits. More particularly, it is an object of this invention to provide a method for mining coal wherein the coal is removed in the form of a suspension in water.

Other objects and advantages of this invention will become apparent from the following detailed description made with reference to the accompanying drawings.

DETAILED DESCRIPTION OF THE INVENTION

Figure 1:
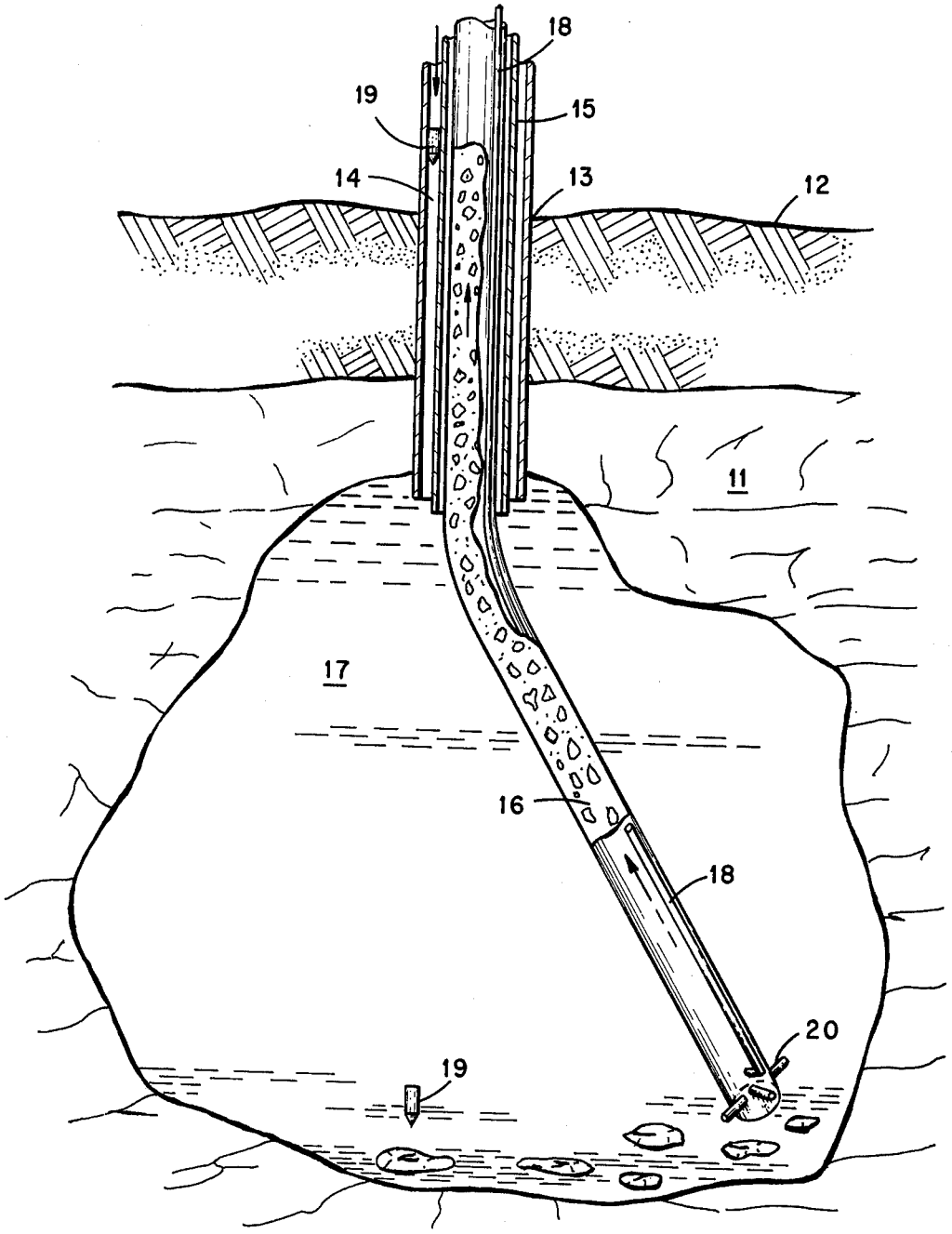
FIG. 1 is a vertical cross section of a coal deposit adapted to the conduct of the mining method of the present invention.

Referring now to FIG. 1 in detail, the numeral 11 refers to a coal seam lying under an overburden formation 12. A borehole 13 is drilled down into the coal seam to communicate with the coal seam, preferably the lower portion thereof. The borehole is provided with conduit 14 which extends therethrough in spaced relation to the walls thereof. The borehole 13 is also provided with a second, or producing conduit 15 extending therethrough in spaced relation to the walls thereof and to conduit 14. Conduit 15 is provided with a vertically adjustable, flexible conduit or pickup tube 16 extending therethrough and into the subsequently formed cavity 17. The distance that pickup tube 16 extends into cavity 17 is adjustable, not only to compensate for the increase in cavity size, but also to remove the tube from the immediate vicinity of the exploding charge. Conduit 16 is preferably fabricated of a rubber tube reinforced with metal or fabric so that it is able to absorb the force of the explosion. In shallow seams, conduits 15 and 16 can be the same tube; in deeper seams conduit 15 and 16 are preferably separate with the inner conduit or pickup tube 16 extending through the lower portion of conduit 15 and into cavity 17. In the latter case, pickup tube 16 is provided with means (not shown), such as a cable, to the surface for lowering and raising the tube. In a preferred mode of operation, conduit 16 is provided with conduit 18 attached to the outside thereof for delivery of compressed air to the bottom of conduit 16 thereby providing an air lift device.

In starting up the mining operation, water is delivered to the coal seam via delivery tube 14, with the space between the borehole and the piping being filled with water to balance the hydrostatic pressure within the conduits. A series of relatively small explosive charges, represented by numeral 19, is dropped through conduit 14. The explosive charges are equipped with firing mechanisms which will detonate the charges at the bottom of the water-filled hole or subsequently formed cavity 17. The water transmits the shock wave from the explosive to the surface of the coal, thereby fracturing and dislodging the coal in the vicinity of the detonation. The unsupported coal above the detonation area, because it is under lithostatic pressure, will also break off. Thus, by fracturing a relatively small amount of coal in a lateral direction, a larger portion will be dislodged by lithostatic pressure. The loose coal, suspended in water, is brought to the surface via conduits 15 and 16 by means of a pump, in this case by air lifting with a device supplied with compressed air by means of conduit 18.

As the coal is removed, a progressively enlarging cavity 17 is created; the size of cavity 17 will be limited by the depth and thickness of coal seam 11. Cavity 17 is maintained substantially filled with water introduced via delivery conduit 14. The intensity of the pressure wave in water caused by the detonation of a high explosive is dependent upon the linear size of the charge and the distance from the explosive, as well as the chemical composition of the explosive itself. The shock wave pressure is effectively defined by the ratio $R/R_o$ where R is the distance from the explosive and $R_o$ is the radius of a spherical explosive charge. Hence, as the diameter of the cavity increases, it will be necessary to increase the size of the explosive charge. The optimum size and weight of explosives used will depend on the optimum value of $R/R_o$, i.e., a shock wave pressure that corresponds to the threshold pressure required to fracture coal.

In the early stages of operation, cavity 17 is relatively small, and the upward velocity of the water is sufficient to exceed the downward velocity of the suspended coal. As the diameter of cavity 17 increases, the average upward velocity of water in the cavity decreases and becomes less than the downward settling velocity of all but the finer particles of coal. To obviate this problem, conduit 16 is adapted to extend to the floor of the progressively enlarging cavity. The coal, in the form of a coal-water slurry, is then transported from the floor of the cavity to the surface via conduits 16 and 15. The low density of coal (1.25 g/cm$^3$) allows it to be hydraulically transported through a vertical pipe in fairly large sizes. In choosing the dimensions of conduits 16 and 15, the strength necessary to withstand water pressure is not a problem; the critical parameter is the diameter which must be large enough to prevent bridging of the fragments. The lower end of tube 16 is preferably provided with a guard (not shown) to prevent the entrance of oversized pieces of coal. Loose coal is moved toward the center of the floor by water motion within the cavity.

In order to pick up as much coal as possible from the floor of the cavity, tube 16 is adapted to move laterally and traverse the floor. Lateral movement of tube 16 is accomplished by four water jets 20 providing thrust at right angles so as to move the tube away from the vertical and swing it in a circular path. Water for these jets is supplied from the surface by means of small conduits, not shown, attached to the outside of tube 16. By varying the thrust in a continuous and controlled manner the end of the tube sweeps the floor in a spiral pattern. The explosive charges would be detonated only when tube 16 is some distance from the center or in a retracted position. Once coal has settled on the cavity floor, it can easily be moved under water because of its low density. Consequently, coal deposited in piles can be leveled by the end of tube 16 fitted with the guard ring.

Figure 2:
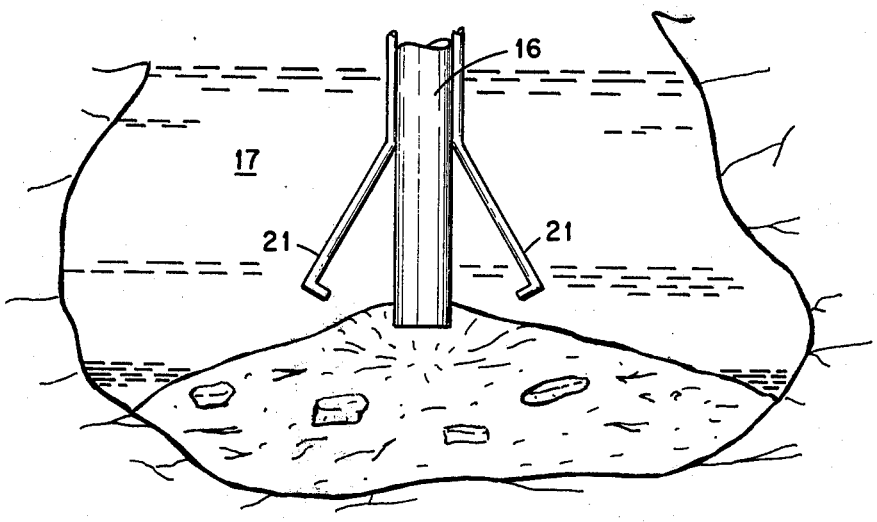
FIG. 2 is a fragmentary vertical cross section of the producing conduit and cavity of FIG. 1 adjacent the lower end thereof and showing an alternative method of picking up loose coal from the cavity floor.

Alternatively, rather than sweeping tube 16 across the floor of the cavity to pick up loose coal, loose coal can be swept by means of water jets toward tube 16 at the center of the cavity. This modification is shown in FIG. 2 wherein numeral 21 represents flexible conduits, for example, rubber hoses, terminating in jets. Conduits 21 are attached to the outside of tube 16 for a substantial portion of its length, with the terminal portions thereof being free to swing outwardly by jet action.

If there are sudden or persistent falls of numerous, massive pieces of coal, a series of small charges can be fired to fracture these pieces. To protect the roof of the cavity from the resulting shock wave, some water can be removed from the cavity in order to create an air cushion at the top. This procedure can also be used to extend the cavity farther in a horizontal direction.

At the surface, the coal-water suspension is pumped to a dewatering station where the coal is recovered, and waste water is returned to cavity 17 via conduit 14.

Considering an example of the hydroexplosive mining method for illustrative purposes, a borehole can be drilled approximately three-fourths of the distance through a coal seam. The borehole is provided with one pipe, approximately 5 cm in diameter, for delivery of water and explosive charges in the cavity in the coal seam and with a second pipe, approximately 20 cm in diameter for transporting the coal-water suspension to the surface. The second pipe is provided at its lower end with a flexible, vertically adjustable pickup tube of approximately the same diameter as the pipe. Initially, a series of relatively small explosive charges consisting of an explosive composition of RDX in oil and polyisobutylene and known in the trade as composition C4 are detonated at the bottom of the borehole. The initial charges are of the order of 0.1 kg. The amount of explosive used and its effective radius for coal fracturing can be calculated according to the optimum value of $R/R_o$ as discussed above. Thus, the explosive charges used can be sized to the diameter of the cavity. Successively larger explosive charges, up to a maximum of about 2–3 kg, will be used in the development of the mine. Considering an optimum value of $R/R_o = 40$, 0.17 kg of explosive will be required per 1000 kg of coal, i.e., a charge weighing 2.1 kg would fracture 12,350 kg of coal if it were detonated in a water-filled cavity with a 3-meter radius. It is not necessary that the charge be spherical, and for purposes of charge manufacture and for introduction through the conduit the preferred shape is a cylinder whose length can be varied. With a water velocity of 1.9 m/s and a solids loading of 22%, 55 metric tons of coal per hour, including pieces up to 250 g, will be transported to the surface.

For the purpose of the present process, a conventional water-proof commercial explosive can be used. Dynamite, being readily obtainable, is particularly suitable.

In developing the mine in accordance with the process of the present invention, the objective is to remove as much coal as possible while allowing the ground to subside evenly. To accomplish this a line of holes can be drilled at a distance apart equal approximately to the thickness of the coal seam being developed. Coal can be extracted from one or several holes. The cavities formed would eventually meet and a long continuous chamber will form. All further rows of holes would well be parallel and equidistant.

There are many deposits where the coal is in numerous overlying seams interspersed with sedimentary rock. In a deposit of this type, a borehole would be drilled through all the seams until the lowest seam was reached. Then each seam would be mined in turn, starting with the lowest. The same borehole would be used, and after each seam had been mined the borehole casing would be partially withdrawn to the next higher seam. Thus, a series of vertical cavities would develop.

One of the major advantages of the hydroexplosive mining method of the present invention is that little heavy, specialized machinery is required. Once the coal is on the surface, for example, it need not be loaded into a truck at pumped head of the borehole; the coal-water suspension can be pumpes to a central holding point for final shipment.

Another advantage of the present type of mining is that environmental damage is minimal compared to conventional mining techniques; in some cases the environment in the vicinity of the mining operation can be left virtually intact. Since Western coal is low in sulfur, its eventual use does not present an unacceptable problem in air pollution. Additionally, noise and ground shock would not be problems because the explosive charges will be small and completely contained. Many Western coal seams are aquifers which, if disrupted, might cause wells and springs in the area to lose water. However, in hydroexplosive mining, the flow of underground water will not be disturbed because the fractured overburden will subside into the space formerly occupied by the coal seam, thereby fulfilling the function of an aquifer.

Still another advantage of the hydroexplosive mining technique of the present invention is that the amount of water required for operation will be nominal since the water used can be recovered and recycled.

The present technique of hydroexplosive mining can also be utilized for increasing the permeability and porosity of underground formations before in situ processing, particularly in situ coal gasification and in situ oil shale retorting. An initial void space can first be created in the formation by hydroexplosive mining; the void space can then be redistributed by subsequent explosive blasting, thus enhancing formation permeability and porosity. The initial void space also provides a free surface which permits the explosive rarefaction wave to exert tensile stress on the formation, a much more effective way to fracture rocks than compressive stress, and thereby allows a more efficient utilization of explosive energy during blasting.

Although the invention has been hereinbefore described and illustrated in the accompanying drawings with respect to specific steps of the method thereof, it will be appreciated that various modifications and changes may be made therein without departing from the true spirit and scope of the invention. Thus, it is not intended to limit the invention except by the terms of the following claims.

What I claim is:

1. A method for recovering coal from a buried coal seam which comprises:

a. establishing a water-filled cavity in communication with said coal seam, b. periodically detonating in said water-filled cavity an explosive charge effective to interact with the water and generate an underwater shock wave of sufficient pressure to fracture and dislodge a portion of the coal seam and form a suspension of loose coal in water, and c. extracting said suspension from the coal seam, thereby forming a progressively enlarging cavity in the coal seam.

2. A method according to claim 1 further defined by maintaining said cavity substantially filled with water.

3. A method according to claim 1 further defined by recovering coal from the extracted suspension.

4. A method according to claim 1 further defined by recovering and recycling water from the extracted suspension.

5. A method according to claim 1 further defined by establishing said water-filled cavity in communication with the lower portion of the coal seam.

6. A method according to claim 1 further defined by providing said cavity with first and second conduits, delivering water and explosive charges to the coal seam via said first conduit, and extracting said suspension via said second conduit.

7. A method according to claim 6 further defined by extracting said suspension by means of an air lift.

8. A method according to claim 6 further defined by said second conduit being adapted for travel in a vertical direction.

9. A method according to claim 6 further defined by extending said second conduit to communicate with the lower portion of said cavity during extraction of the coal-water suspension and retracting said conduit prior to detonation of an explosive charge.

* * * * *